US005206662A

United States Patent [19]

Fox et al.

[11] Patent Number: 5,206,662

[45] Date of Patent: Apr. 27, 1993

[54] METHOD AND APPARATUS FOR ADJUSTING CONTACT PRESSURE OF A THERMAL PRINTHEAD

[75] Inventors: Duane M. Fox, Snohomish; Edward D. Caldwell, Seattle; William P. Stiles, Bothell, all of Wash.

[73] Assignee: Intermec Corporation, Everett, Wash.

[21] Appl. No.: 683,459

[22] Filed: Apr. 8, 1991

[51] Int. Cl.[5] ..... B41J 25/304; B41J 25/312

[52] U.S. Cl. ..... 346/76 PH

[58] Field of Search ..... 346/76 PH; 400/120 HE, 400/56, 120

[56] References Cited

U.S. PATENT DOCUMENTS 4,844,632 7/1989 Minowa ..... 346/76 PH
4,879,566 11/1989 Hanabusa ..... 346/76 PH

FOREIGN PATENT DOCUMENTS 0221558 9/1987 Japan ..... 400/120 HE
0222881 9/1988 Japan ..... 400/120 HE

*Primary Examiner*—Benjamin R. Fuller
*Assistant Examiner*—N. Le
*Attorney, Agent, or Firm*—Seed and Berry

[57] ABSTRACT

A method and apparatus for adjusting the contact pressure of a thermal printhead against a platen roller. In response to the receipt of a control signal, a spring mechanism is activated to apply a torque against an arm attached to a shaft. Rotation of the shaft first brings the printhead into contact with a thermal medium which passes between the printhead and the platen roller. After the printhead contacts the thermal medium, further force applied through the spring selectively increases the torque which, in turn, increases the pressure of the printhead against the thermal medium. The pressure is adjustable as a function of the thermal medium, print speed, user darkness preference and other variables.

7 Claims, 13 Drawing Sheets

METHOD AND APPARATUS FOR ADJUSTING CONTACT PRESSURE OF A THERMAL PRINTHEAD

TECHNICAL FIELD

The present invention relates to thermal printers and more particularly to a method and apparatus for adjusting the contact pressure of a thermal printhead.

BACKGROUND OF THE INVENTION

It is known in the prior art to use printers with thermal printheads to produce contrasting images on a print medium such as a label stock. In one form, such printheads directly contact a thermally sensitive print medium. In others, a ribbon carrying a thermally transferrable dyed wax is placed between the printhead and a thermally insensitive print medium.

The wide applicability of such printers allows them to be used with many different types of print medium, having, for example, different thicknesses and different thermal sensitivities. It has been determined that the pressure that the printhead exerts against the print medium determines to a large extent the quality of printing provided by a thermal printer. Therefore, it is desirable to have a thermal printer with adjustable printhead pressure.

SUMMARY OF THE INVENTION

In one aspect, the invention is an apparatus for variably adjusting the contact pressure of a printhead against a print medium in accordance with a control signal. The apparatus comprises means for receiving the control signal and biasing means to adjust the pressure of the printhead against the print medium in response to the control signal.

In another aspect, the invention is a method for variably adjusting the contact pressure of a printhead against a print medium in accordance with a control signal. The method comprises the steps of receiving the control signal and adjusting the pressure of the printhead against the print medium in response to the control signal.

DETAILED DESCRIPTION OF THE INVENTION

Figure 1:
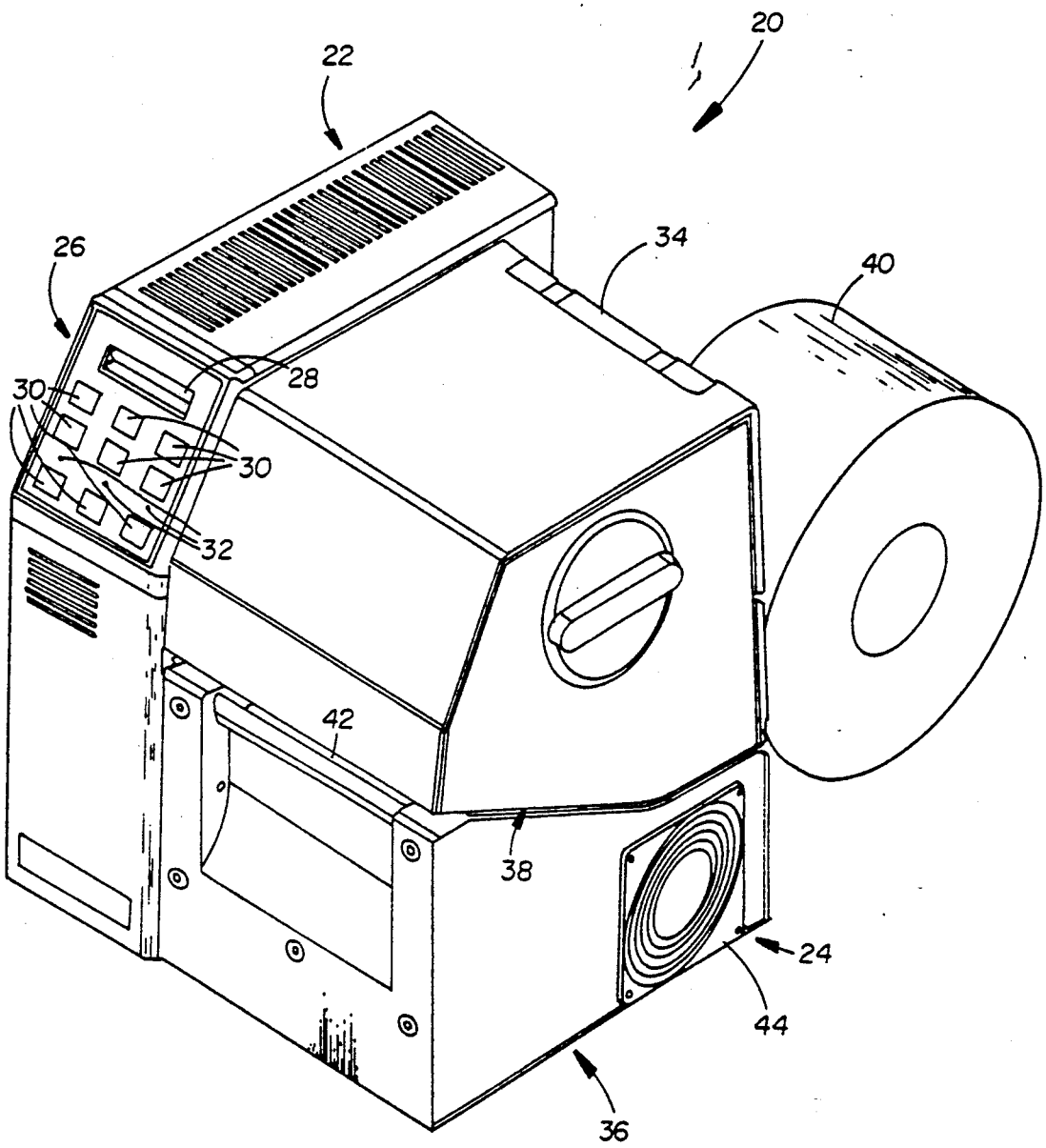
FIG. 1 is a perspective view of a thermal printer for printing on a print medium passing along a print path, the print path being closed.

FIG. 1 is a perspective view of a thermal printer 20 for printing on a print medium passing along a print path, the print path being closed. The thermal printer 20 includes a first housing 22 and a second housing 24. The first housing 22 encloses electrical components mounted on printed circuit boards. The first housing 22 also includes a control panel 26 which allows the thermal printer 20 to be controlled and adjusted by a user.

The control panel 26 includes a liquid crystal display (LCD) 28, a plurality of buttons 30, and a plurality of light emitting diodes (LEDs) 32. The LCD 28 provides an alphanumeric display of various commands useful for the user to control and adjust the thermal printer 20. The buttons 30 implement the user's choices of controls and adjustments, and the LEDs 32 provide displays of the status of the thermal printer 20. For example, one of the buttons 30 can be used to toggle the thermal printer 20 on- and off-line, with one of the LEDs 32 lighting indicating when the printer is on-line. Another one of the buttons 30 can be used to select an array of menus including choices of print speeds and media types, among other choices. Another one of the buttons 30 can be used to reload or advance the printer medium through the thermal printer 20. Yet another button 30 can be used to open the thermal printer in order to change the printer medium.

The second housing 24 includes a printer module 34 and a motor drive module 36 which are normally latched together. The printer module 34 and the motor drive module 36 are separated by a printer medium path 38 along which the print medium passes. By activating another one of the buttons 30, the printer module 34 can be caused to unlatch from the motor drive module 36 so that it can be rotated backwards, in a clockwise direction, to the position seen in FIG. 2. This action opens the printer medium path 38 and allows the adjustment and replacement of the printer medium which is introduced into the printer medium path 38 from a printer medium roll 40. The printer medium supplied on the printer medium roll 40 is available in a variety of thicknesses, thermal sensitivities, and materials, depending upon the use to be made of the printer medium. The printer medium supplied from the printer medium roll 40 passes through the printer medium path 38 and exits through an opening 42. If the printer medium is a thermal transfer medium, a thermal transfer ribbon is placed in a separate drive mechanism contained within the printer module 34. This separate drive mechanism provides supply and take-up rolls for the thermal transfer ribbon, the rolls being separately controllable from the movement of the printer medium in order, for example, to save the ribbon when the printer medium contains areas where no printing is required. The motor drive module 36 also contains a cooling fan (not shown) which exhausts air through a grill 44.

Figure 2:
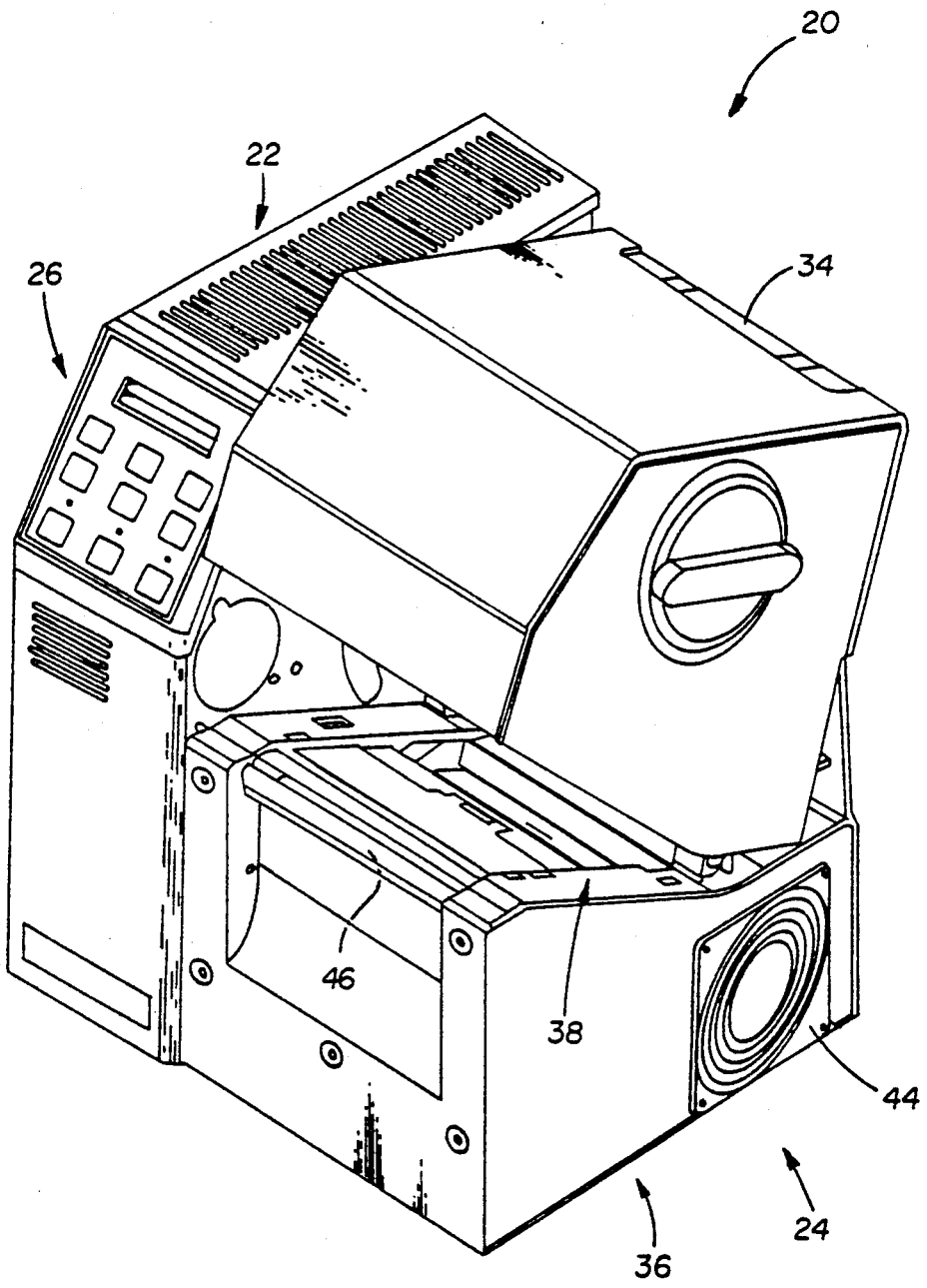
FIG. 2 is a perspective drawing of the printer of FIG. 1, with the print path being open.

FIG. 2 is a perspective drawing of the thermal printer 20 of FIG. 1, with the print path being open. It shows the thermal printer of FIG. 1, with its printer module 34 in an open position, exposing the printer medium path 38. The printer medium path 38 is defined between the lower surface of the printer module 34 and the upper surface of the motor drive module 36.

The printer medium from the printer medium roll 40 passes through the printer medium path 38 with its printed side facing up. The printer medium is advanced through the printer medium path 38 by an advancement mechanism (to be described subsequently) and forced to pass between a platen roller 46 positioned within the motor drive module 36 at the opening 42 of the printer medium path 38 and a thermal printhead 80 (see FIG. 5), which is positioned within the printer module 34. The printer medium, which has been printed on, exits through the opening 42 (shown in FIG. 1).

When the printer module 34 is latched to the motor drive module 36, the printer medium is forced against the thermal printhead 80 by the platen roller 46. In order to accommodate a wide variety of printer media, the pressure between the platen roller 46 and the printhead 80 is variably adjustable.

Figure 3:
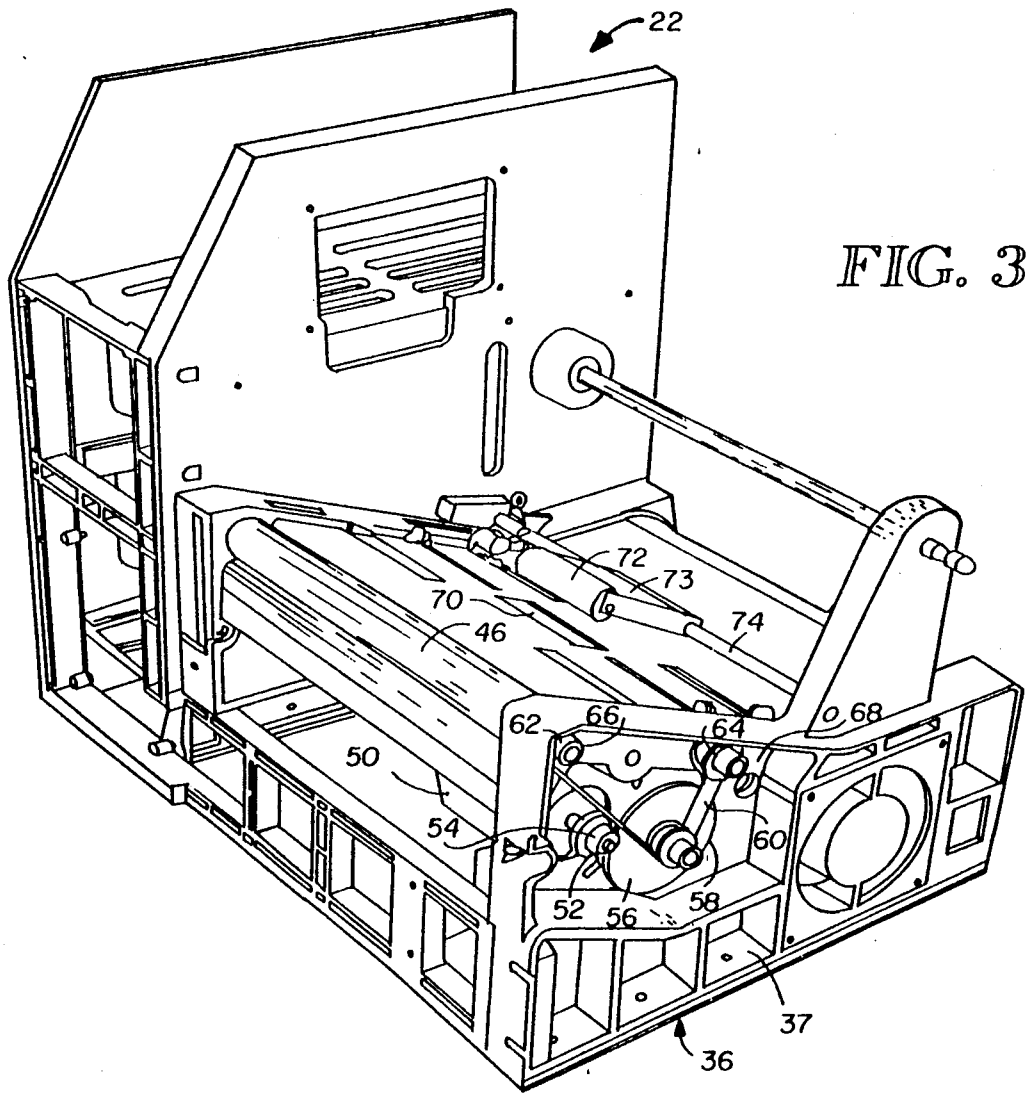
FIG. 3 is a perspective drawing of the paper tracking section of the thermal printer shown in FIG. 1.

FIG. 3 is a perspective drawing of the paper tracking section of the thermal printer 20 shown in FIG. 1. The motor drive module 36 includes a stepper motor 50 having a shaft 52 with a drive gear 54 attached near its end. The stepper motor 50 is controlled by electrical circuitry contained in the first housing 22.

The drive gear 54 engages a large gear 56 which drives a pulley 58. The pulley 58 engages a belt 60 which also passes over two equally-sized pulleys 62 and 64. The pulley 62 is attached to the end of a platen shaft 66 which drives the platen roller 46. The pulley 64 is attached to the end of a pinch roller shaft 68 which supports a slew roller 70. A pinch roller 72, which is held by member 73, can be caused to rotate about a pivot shaft 74 toward the slew roller 70 with the printer medium therebetween. When this happens, any printer medium passing through the printer medium path 38 will be driven toward the opening 42 by the driven slew roller 70. The speed at which the printer medium is advanced toward the opening 42 is governed by the rotational speed of the pinch roller shaft 68. The platen shaft 66, which is driven at the same speed as the pinch roller shaft 68, causes the printer medium to pass between the platen roller 46 and the thermal printhead 80 (shown in FIG. 5) at the same speed.

When the thermal printer 20 is printing, the platen roller 46 moves the printer medium Otherwise, as will be seen, the platen roller 46 is not frictionally engaged with the printer medium and the slew roller 70 working in conjunction with the pinch roller 72 advance the printer medium through the thermal printer 20.

Figure 4:
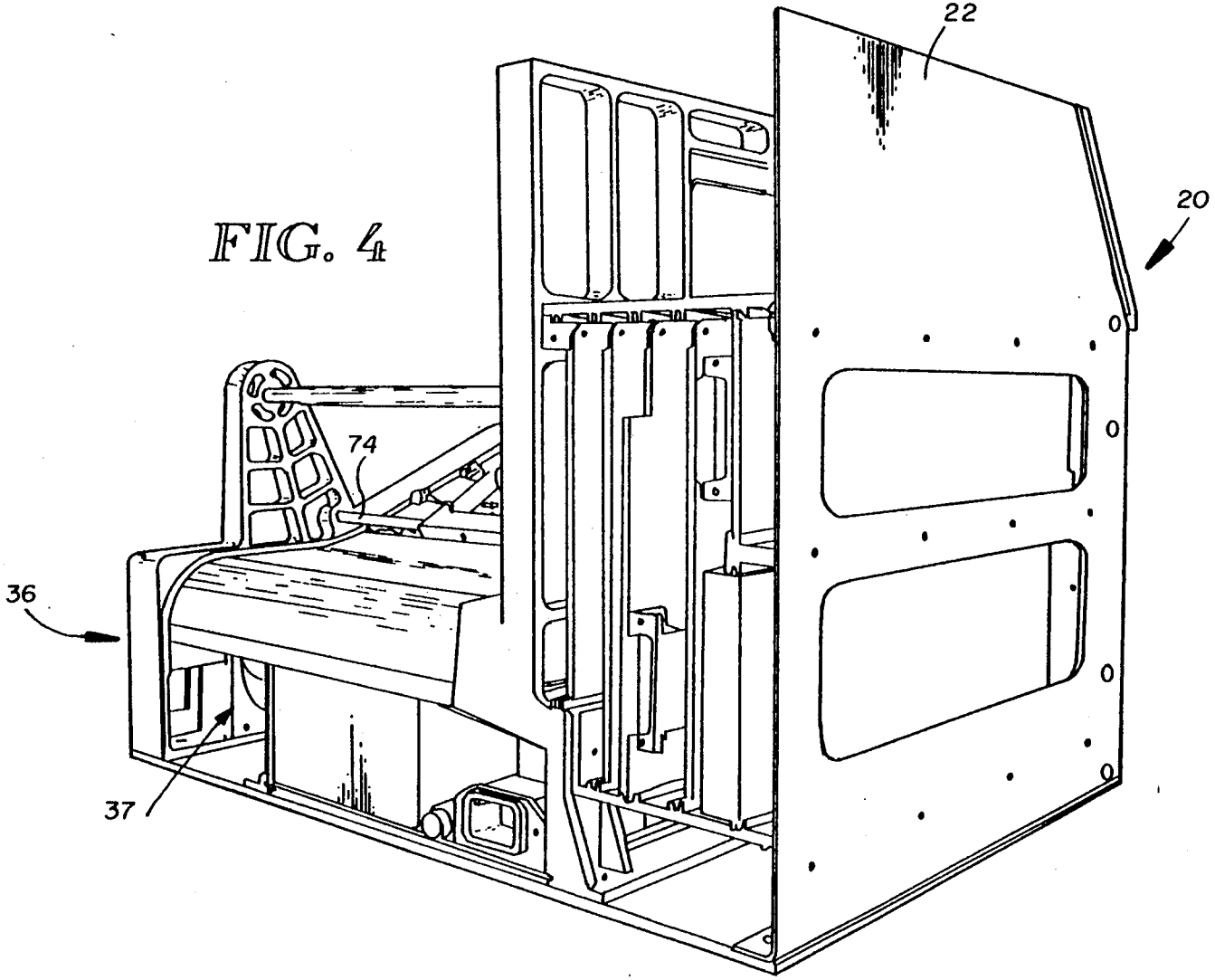
FIG. 4 is a perspective drawing of the paper tracking section of FIG. 3, shown from an opposite direction to the perspective view of FIG. 3.
Figure 5:
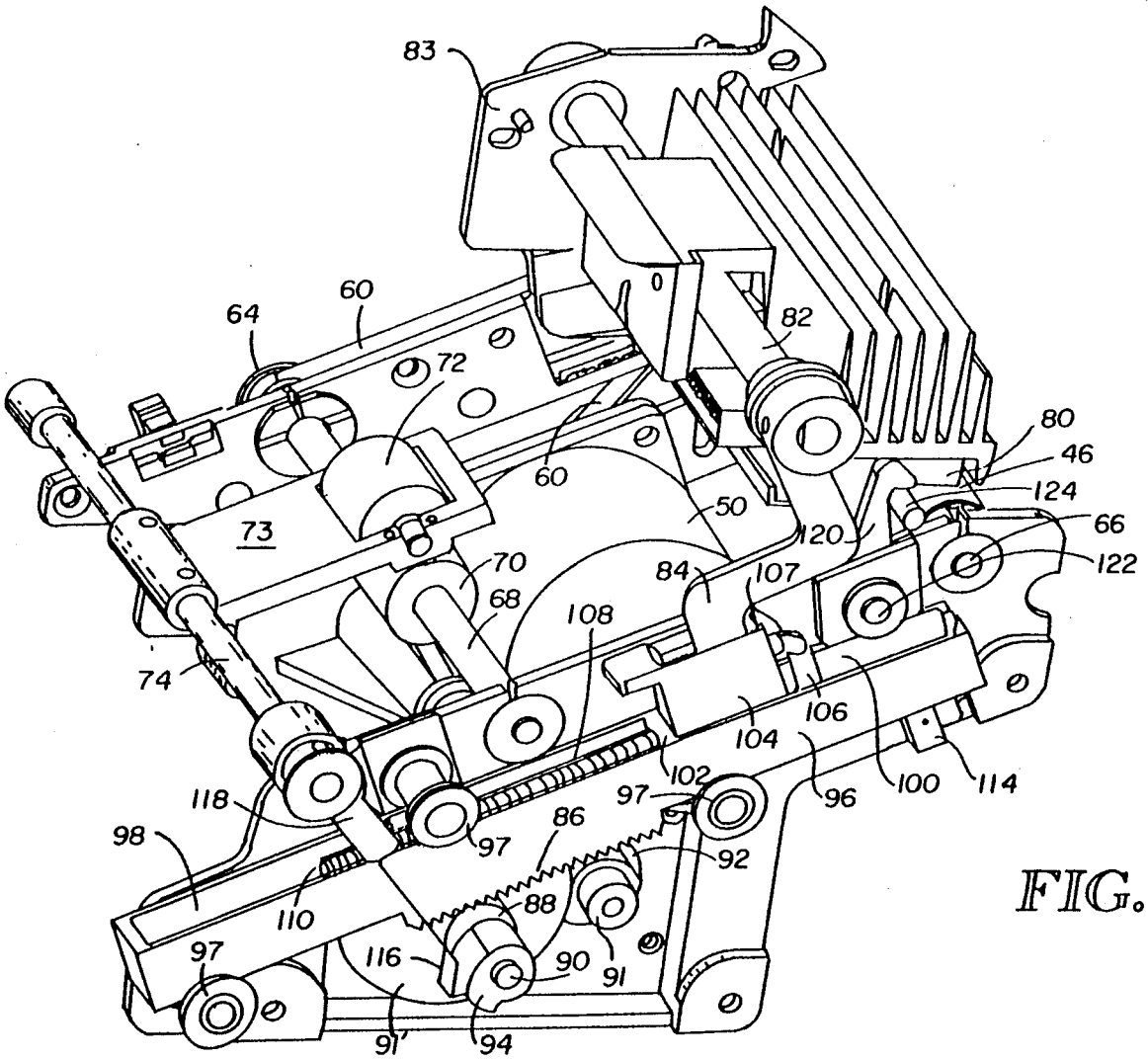
FIG. 5 is a perspective view of a preferred embodiment of an adjustable printhead pressure mechanism used with the thermal printer of FIG. 1.

FIG. 4 is a perspective drawing of the paper tracking section of FIG. 3, shown from an opposite direction to the perspective view of FIG. 3. FIG. 5 is a perspective view of a preferred embodiment of an adjustable printhead pressure mechanism for use with the thermal printer of FIGS. 1–4, shown from the same perspective as FIG. 4. The printhead 80 pivots about a shaft 82 rotatably supported by a frame portion 83 of the printer module 34. The shaft 82 has one end affixed to an arm 84. Accordingly, a clockwise movement of the arm 84 (as viewed in FIG. 5) rotates the shaft 82 clockwise and causes the printhead 80 to move toward the platen roller 46.

The printer module 34 is connected to the motor drive module 36 when the thermal printer 20 is in use by a latch 120 which pivots about a latch shaft 122 that is rotatably supported by a frame portion 37 of the motor drive module 36. The latch 120, which is driven by a mechanism (not shown) in the motor drive module 36, engages a pin 124 which projects from the printer module 34. When latched, the printhead 80 is moved so that it is engaged against the printer medium passing between the platen roller 46 and the printhead 80. Clockwise movement of the arm 84 about the shaft 82 causes the pressure of the printhead 80 against the printer medium to increase Such movements of the arm 84 are controlled by rack and pinion mechanism which includes a rack 86 including teeth and a pinion gear 88. The pinion gear 88 is attached to a shaft 90, which is driven through reduction gears 91, 91' by a stepper motor 92. A cam 94 is attached to the end of the shaft 90.

The rack 86 is formed as part of a carrier 96 which includes a first cavity 98 and a second cavity 100. The carrier 96 is restrained by rollers 97, which allow it to move only linearly. The first cavity 98 and the second cavity 100 are separated by a wall 102. A receiver 104, adapted to receive the free end of the arm 84, is placed in the second cavity 100, adjacent to the wall 102. When the printer module 34 is unlatched from the motor drive module 36, the arm 84 can be moved out of the receiver 104.

A wire form 106 has an end 107 which bears against the right-hand wall of the receiver 104 and has two 90-degree bends which cause it to pass to the left through a cutout (not shown) in the lower portion of the receiver 104 and through a hole in the wall 102 into the first cavity 98. A spring 108 positioned on the portion. of the wire form 106 extending into the first cavity 98, between the wall 102 and an end 110 of the wire form 106, and causes the wire form 106 to exert a leftward force against the receiver 104 which applies a leftward force on the arm 84.

When the stepper motor 92 is activated to cause the pinion gear 88 to rotate in a counterclockwise direction, the rack 86 moves the carrier 96 to the left. This action, in turn, causes the wall 102 to compress the spring 108 around the portion of the wire form 106 in the first cavity 98. The spring 108 thereby applies a leftward force on the wire form 106 which applies a leftward force against the receiver 104 in the second cavity 100. This leftward force is transmitted by the receiver 104 to the arm 84 received therein. As the pinion gear 88 continues to rotate in the counterclockwise direction, the leftward force against the arm 84 increases, creating a clockwise torque on the shaft 82. This torque moves the printhead 80 toward the printer medium and increases the pressure of the printhead on the printer medium passing between the printhead and the platen roller 46. Continuing counterclockwise operation of the stepper motor 92 causes further compression of the spring 108, thereby increasing the pressure of the printhead 80 against the printhead medium.

Figure 6:
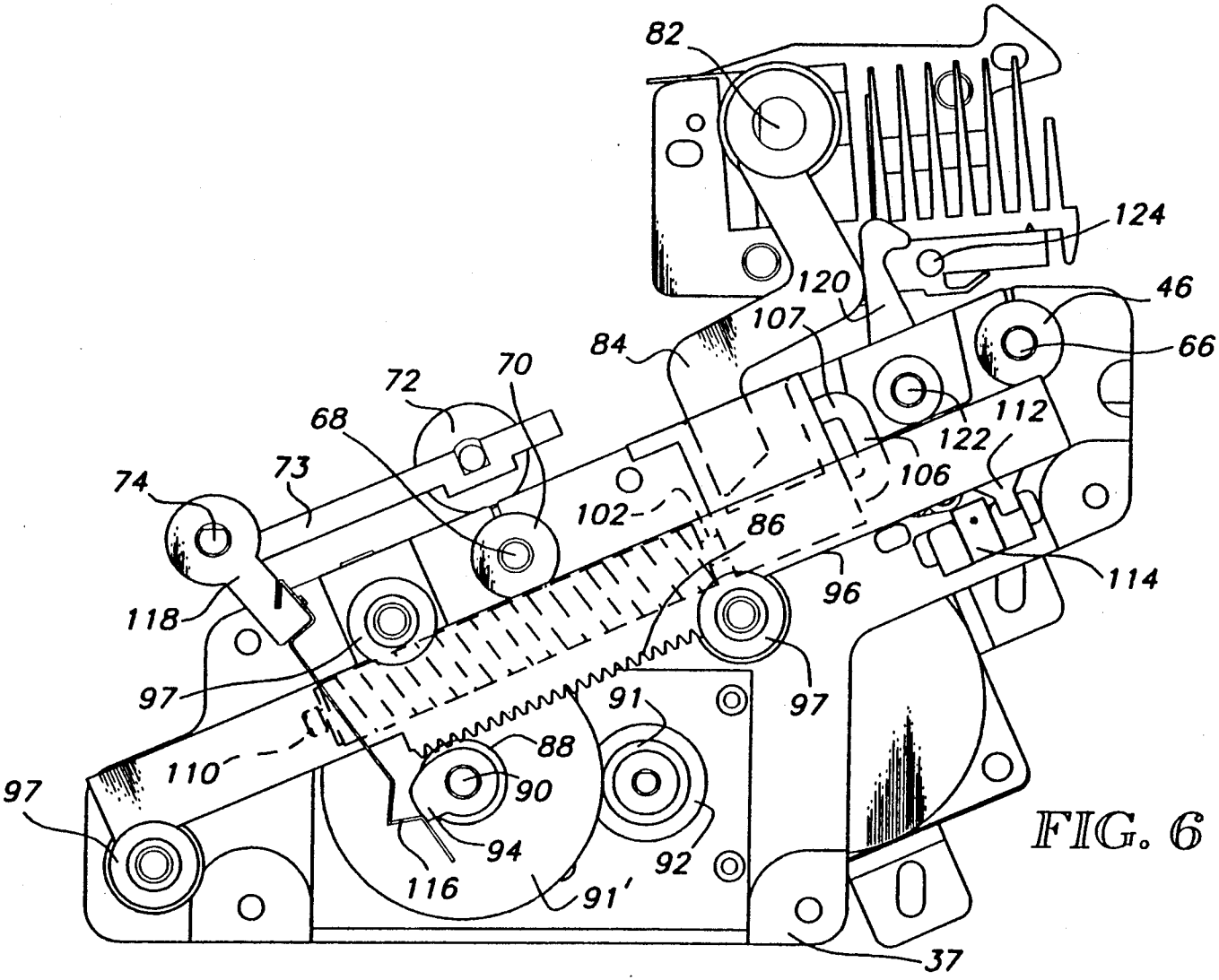
FIG. 6 is a side elevational view of the adjustable printhead pressure mechanism of FIG. 5, shown in an unlatched mode.
Figure 7:
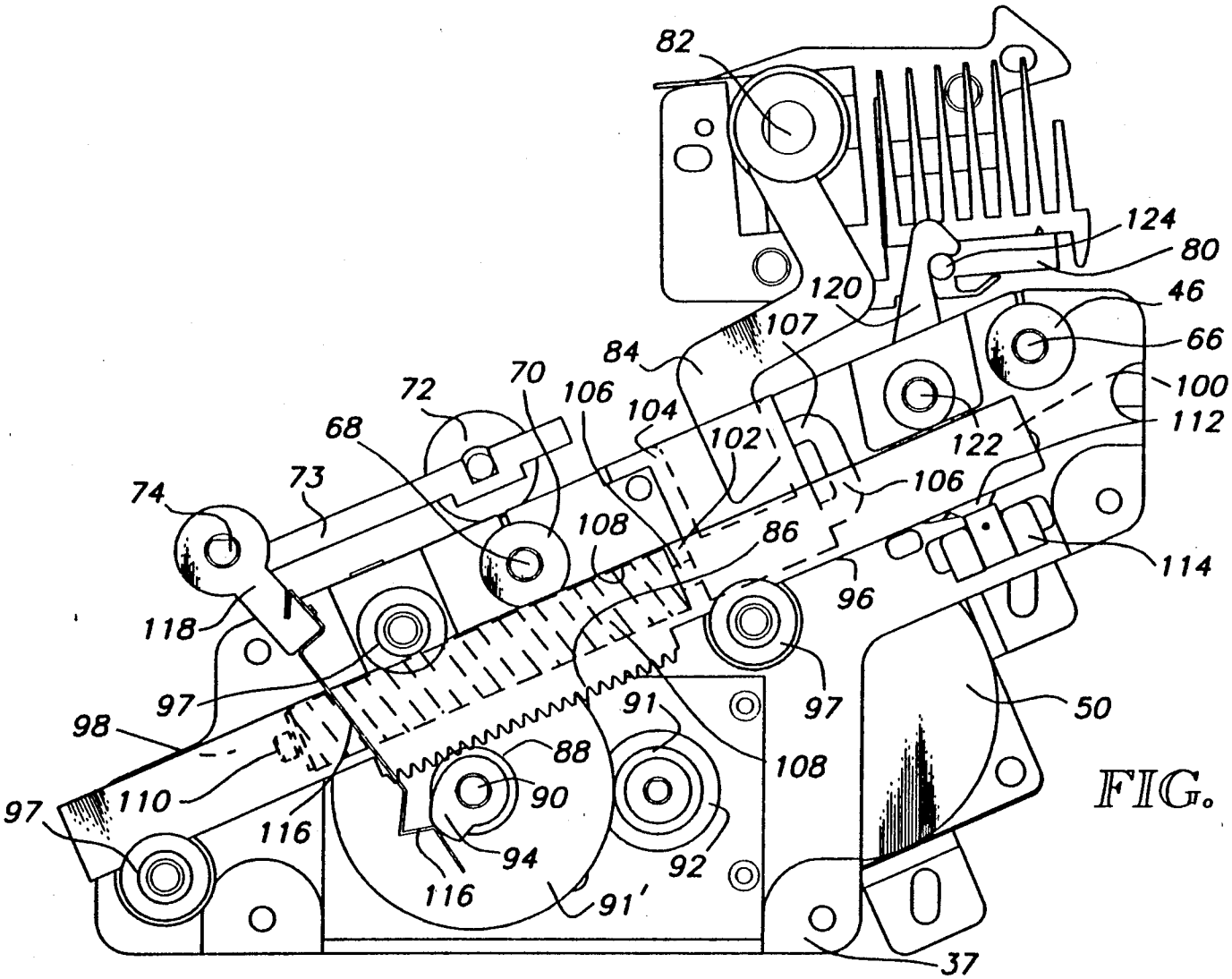
FIG. 7 is a side elevational view of the adjustable printhead pressure mechanism of FIG. 5, shown in an idle mode.
Figure 8:
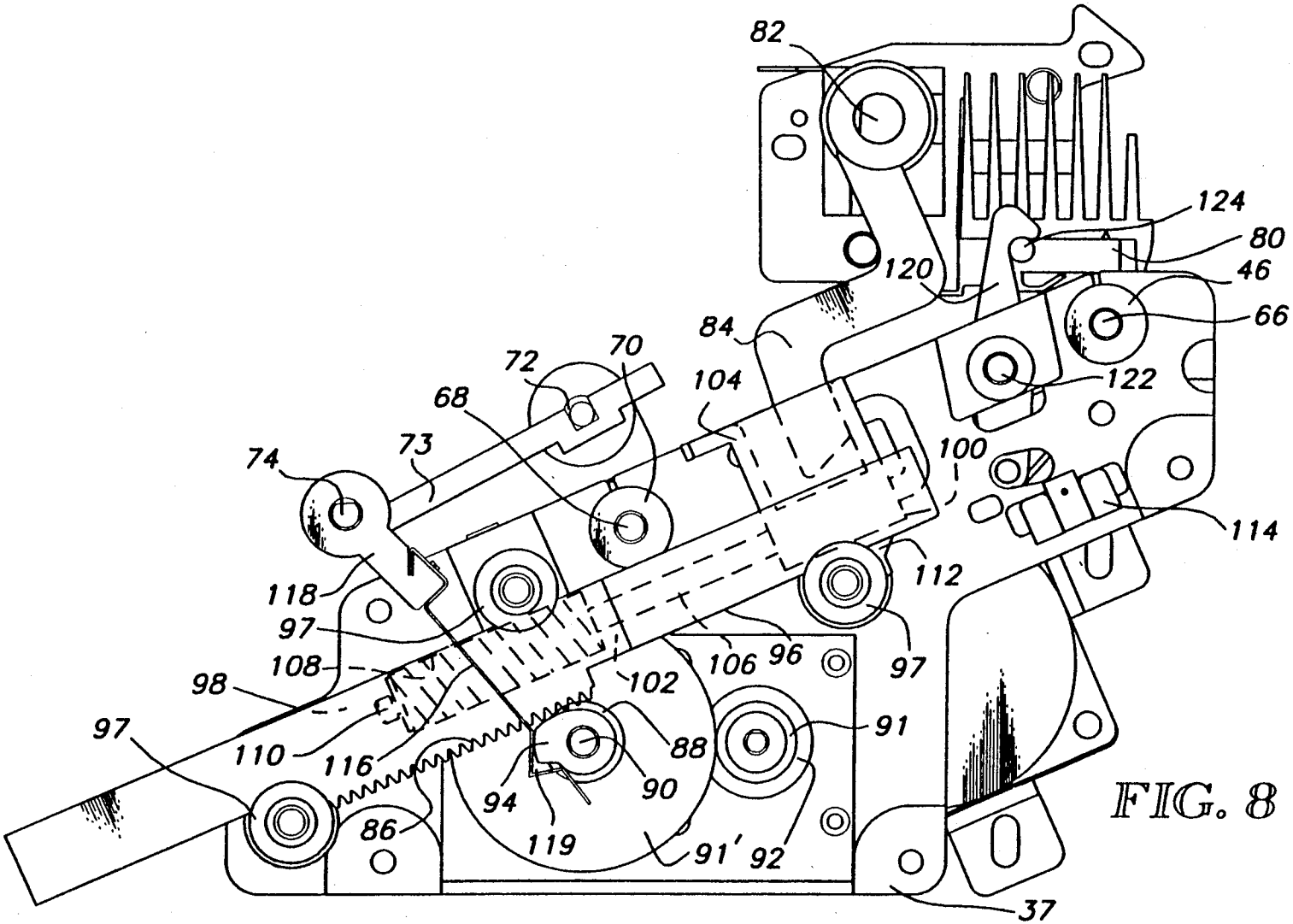
FIG. 8 is a side elevational view of the adjustable printhead pressure mechanism of FIG. 5, shown in a printing mode.

As best shown in FIGS. 6–8, a projection 112 is attached to the bottom of the carrier 96. The projection 112 passes between the two opposing faces of an optical caliper detector 114, which is held fixed with respect to the motor drive module frame 37. If the stepper motor 92 causes the carrier 96 to slew to the right, the projection 112 will pass between the two halves of the optical caliper detector 114, breaking a light beam which passes from one face of the optical caliper detector to the other face of the optical caliper detector. Breaking the light beam causes the optical caliper detector 114 to produce an electrical signal indicating that the carrier 96 has reached a "home" position in which the printhead 80 is moved away from the platen roller 46 by a predetermined repeatable distance. As the carrier 96 moves to the left from the home position, the number of pulses provided to the stepper motor 92 increases from zero, the count at the home position. Therefore, by resetting the carrier 96 to the home position each time the paper path is opened, it is possible to make the pressure of the printhead 80 against the printer medium passing over the platen roller 46 highly repeatable.

The cam 94 on the end of the shaft 90 engages one end of a leaf spring 116. The other end of the leaf spring 116 is attached to a pivot arm 118, which, in turn, is fixed to the end of the pivot shaft 74. Accordingly, as the cam 94 actuates the leaf spring 116, pivot shaft 76 rotates in a clockwise direction, causing the pinch roller 72 to be forced toward the slew roller 70 and capture the printer medium passing therebetween.

Three positions of the rack and pinion assembly of the motor drive module 36 are shown in FIGS. 6, 7 and 8. FIG. 6 is a side elevational view of the adjustable printhead pressure mechanism of FIG. 5, shown in an "unlatched" mode. In this mode, the carrier 96 is moved to the right past the "home" position, so that the projection 112 is positioned to the right of the optical caliper detector 114. In this position, the carrier 96 engages the lower end of the latch 120 which pivots the latch shaft 122, causing the latch 120 to rotate counterclockwise, disengaging the upper end of the latch 120 from the pin 124 which projects outwardly from the printer module 34. In this position, the printhead 80 and the associated shaft 82 and arm 84 can be moved upwardly away from the motor drive module 36, with the printer module 34, to which they are attached. In the unlatched mode, the pinch roller 72 is rotated toward the slew roller 70 by the action of the cam 94 against the leaf spring 116.

FIG. 7 is a side elevational view of the adjustable printhead pressure mechanism of FIG. 6, shown in an "idle" mode, engaging the pinch roller 72 against the printer medium passing between the pinch rollers 70 and the pinch roller 72. The latch 120 is engaged with the pin 124. At the same time, the printhead 80 is separated from the platen roller 46 by the predetermined distance mentioned above to allow the printer medium to be advanced through the printer medium path 38 without printing. In the idle mode the carrier 96 is in the home position.

FIG. 8 is a side elevational view of the adjustable printhead pressure mechanism of FIG. 6, shown in a "print" mode. The carrier 96 has been moved to the left of the home position by a counterclockwise rotation of the stepper motor 92, which causes the cam 94 to enter a detent 119 in the leaf spring 116 and allows the pinch roller 72 to move away from the slew roller 70. In the print mode, the printer medium is advanced through the printer medium path 38 by the force of the platen roller 46 against the printer medium resulting from the pressure applied to the printer medium by the printhead 80.

Figure 9:
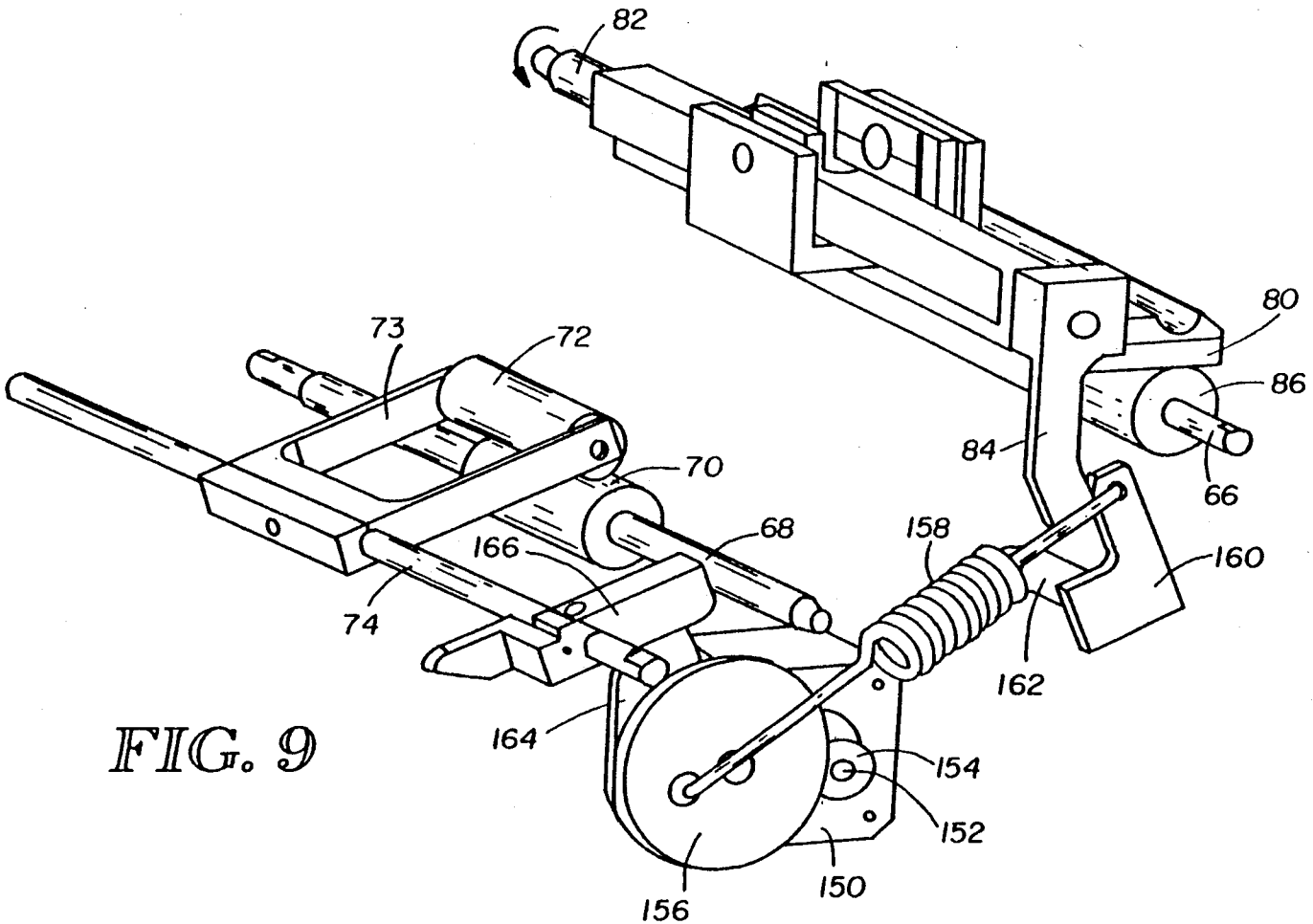
FIG. 9 is a schematic perspective view of a second embodiment of an adjustable printhead pressure mechanism for use with the thermal printer of FIG. 1.
Figure 10:
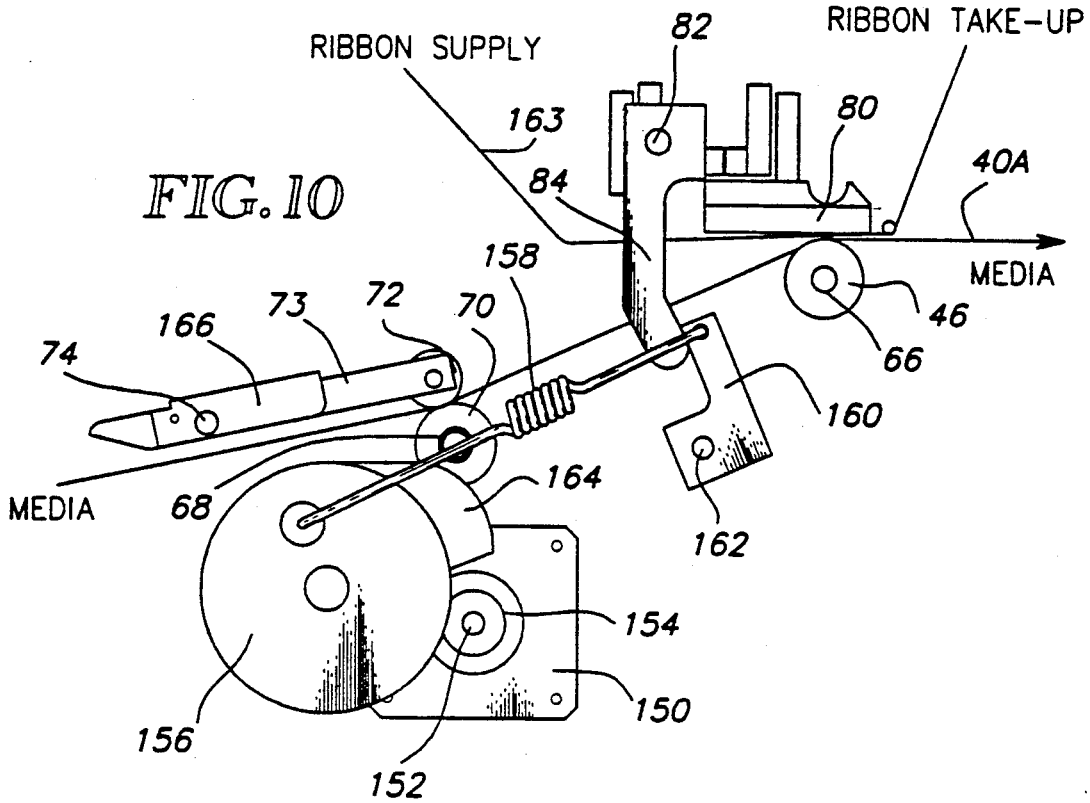
FIG. 10 is a side elevational view of the adjustable printhead pressure mechanism of FIG. 9, shown in a "ribbon save" mode.
Figure 11:
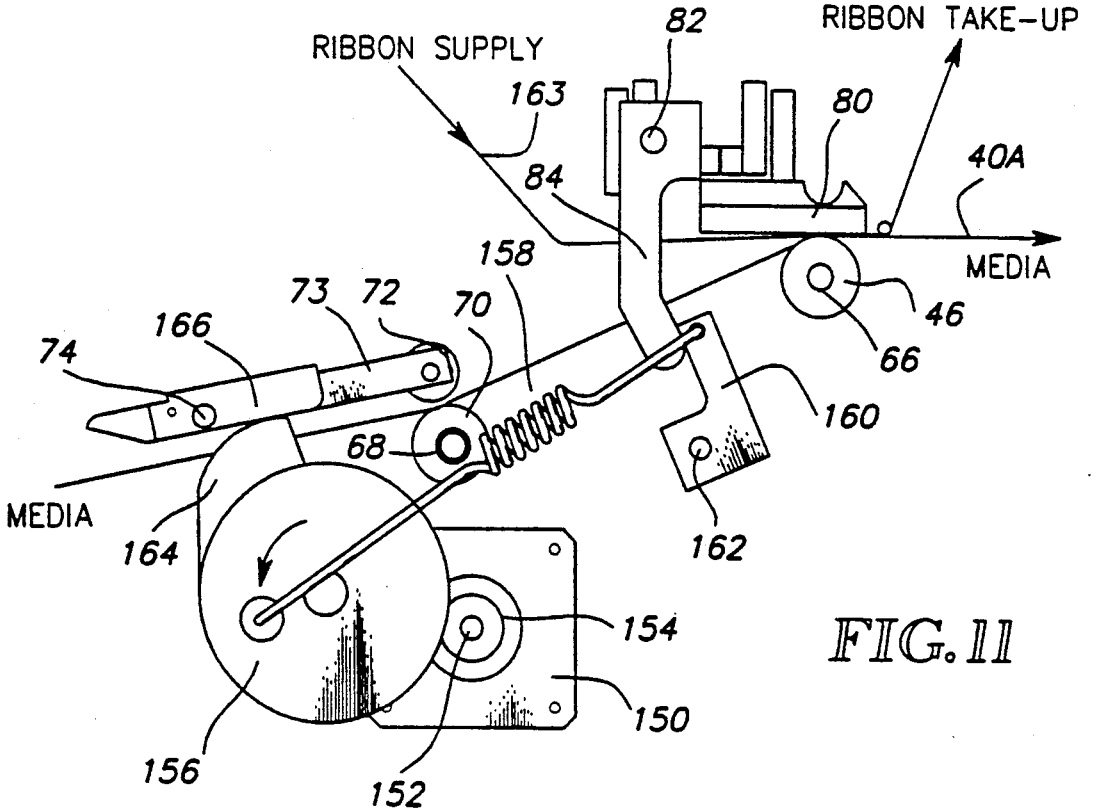
FIG. 11 is a side elevational view of the adjustable printhead pressure mechanism of FIGS. 9 and 10, shown in a "print" mode.

FIGS. 9, 10 and 11 are schematic diagrams of a second embodiment of a printhead pressure mechanism for use with the thermal printer of FIGS. 1-4, wherein the parts which are common to the preferred embodiment shown in FIGS. 5-8 are denoted by the same reference numbers. In the embodiment of FIGS. 9-11, a stepper motor 150 turns a motor shaft 152, to which is attached a pinion gear 154. The pinion gear 154 engages a spring gear 156, causing it to rotate about its center in an opposite direction from the pinion gear 154. A coil spring 158 is attached between an eccentric point on the spring gear 156 and one end of a pivot pawl 160, which rotates about a pivot pawl shaft 162.

As shown in FIGS. 10 and 11, the printer medium exemplified is a thermal transfer printer medium 40A, requiring the use of a thermal transfer ribbon 163. The thermal transfer ribbon 163 is supplied by a ribbon supply reel (not shown) and taken up by a ribbon take-up reel (not shown). The ribbon supply and ribbon take-up reels are respectively driven by ribbon supply and ribbon take-up motors (not shown). The thermal transfer ribbon 163, as well as the ribbon supply reel, ribbon take-up reel, ribbon supply motor and ribbon take-up motor, are located in the printer module 34.

A cam 164 rotates with the spring gear 156 and can be rotated to engage a cam follower 166 which is attached to the pivot shaft 74. The end of the pivot pawl 160 to which the coil spring 158 is attached engages the arm 84, applying a clockwise torque to the shaft 82 and forcing the printhead 80 toward the platen roller 46. The force of the printhead 80 is proportional to the extension of the coil spring 158.

In the ribbon save mode, shown in FIG. 10, the ribbon supply and ribbon take-up motors are not energized, so the thermal transfer ribbon 163 is not moving. The motor 150 has rotated the motor shaft 152 and the attached pinion gear 154 counterclockwise, and caused the spring gear 156 and the attached cam 164 to rotate clockwise, relieving the tension on the coil spring 158. This, in turn, relieves the pressure on the arm 84 and allows the printhead to rotate counterclockwise, away from the platen roller 46. In this position, the arm 84 can be disengaged from the pivot pawl 160 if it is desired to unlatch the print module 34 from the motor drive module 36. In the ribbon save mode the cam 164 is disengaged from the cam follower 166, allowing the pinch roller 72 to move toward slew roller 70, thereby engaging and driving the print medium through the printer medium path 38. Simultaneously, the thermal transfer ribbon 163 is disengaged from the printer medium 40A because of the absence of any pressure of the printhead 80 against the platen roller 46. This allows the thermal transfer ribbon 163 to remain stationary while the printer medium 40A passes through the printer medium path 38, thereby conserving the thermal transfer ribbon.

In the print mode, shown in FIG. 11, the stepper motor 150 has caused the motor shaft 152, and the pinion gear 154 to which it is attached, to rotate in a clockwise direction, driving the spring gear 156 and the cam 164 in a counterclockwise direction. This motion moves the attachment point of the coil spring 158 away from the pivot pawl 160, elongating the coil spring 158 and applying a leftward force to the arm 84. This force applies a clockwise torque to the shaft 82, moving the printhead 80 toward the platen roller 46 and forcing the thermal transfer ribbon 163 against the printer medium in printer medium path 38. At the same time, the cam 164 engages the cam follower 166, rotating it about the pivot shaft 74 and lifting the pinch roller 72 away from the slew roller 70. In this mode, in conjunction with energization of the ribbon supply and ribbon take-up motors, the printer medium 40A and the thermal transfer ribbon 163 are moved together by the pressure of the printhead 80 toward the platen roller 46. The pressure of the printhead 80 on the thermal transfer ribbon 163 and the printer medium 40A is gradually increased as the spring gear 156 is rotated counter-clockwise, until the maximum pressure position shown in FIG. 11 is reached.

Figure 12A:
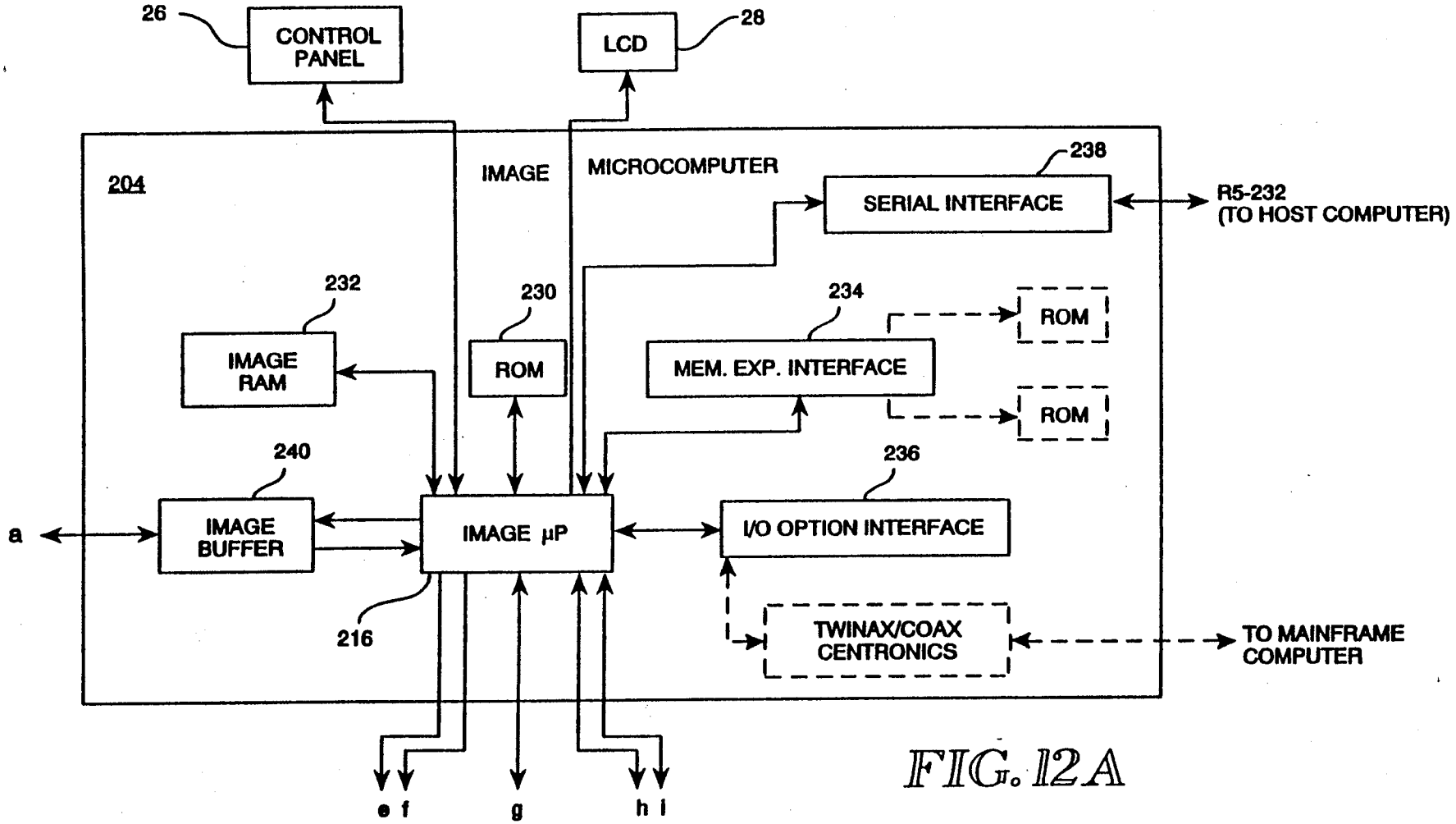
FIGS. 12A–12C comprise a block diagram of the electrical circuitry used with the adjustable printhead pressure mechanisms of FIGS. 5–8 and FIGS. 9–11.
Figure 12B:
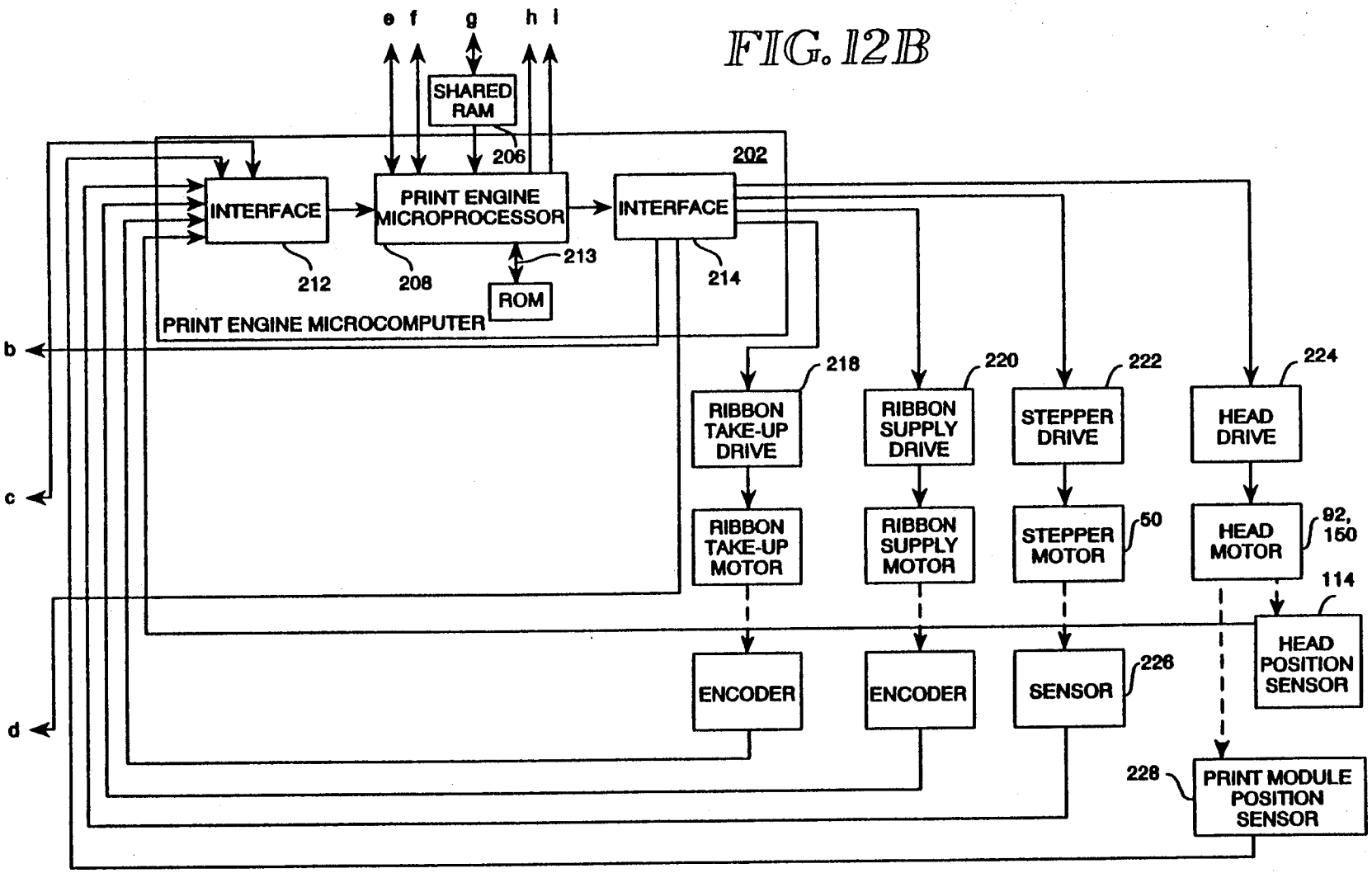
Figure 12C:
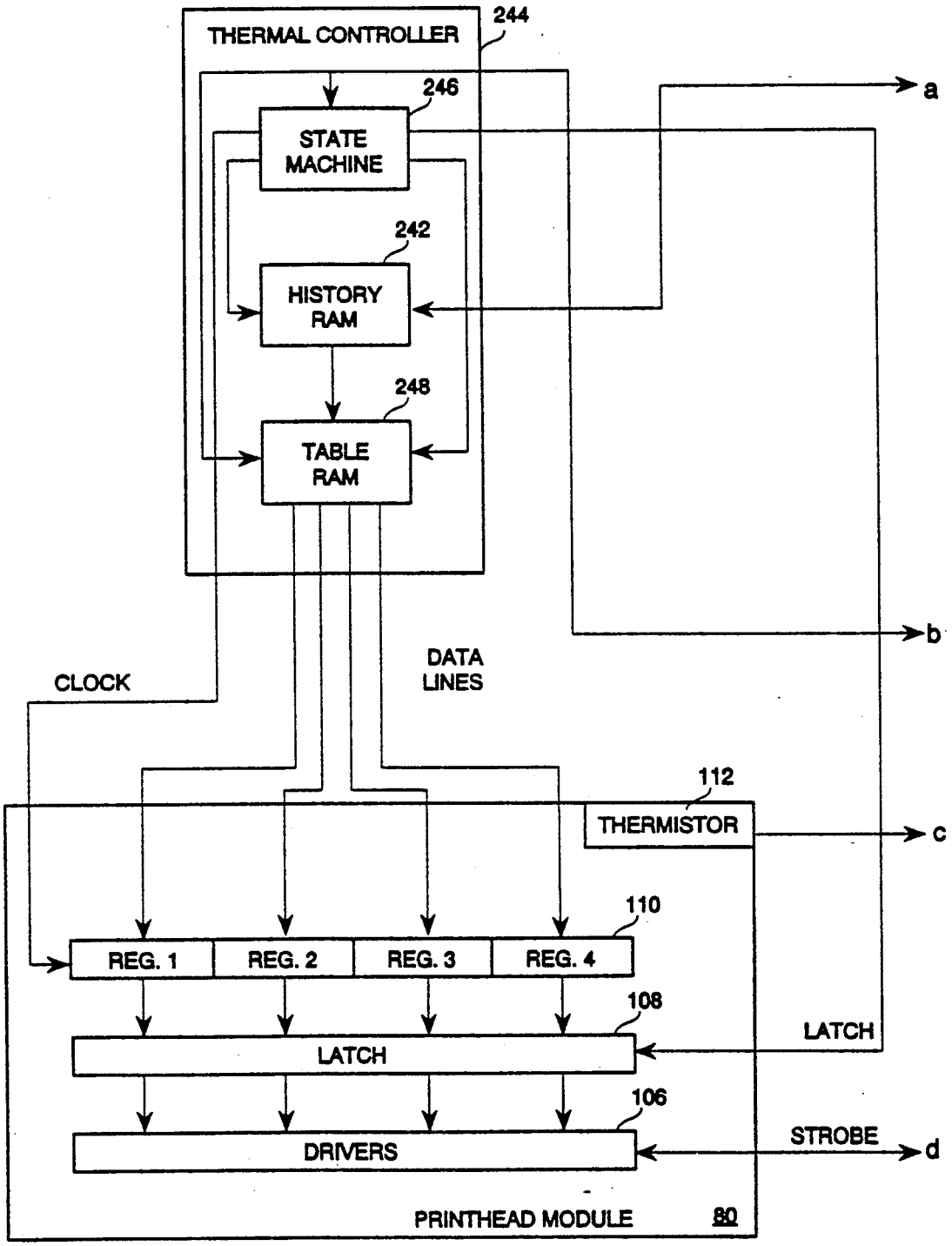

FIGS. 12A–12C comprise a block diagram of the electrical circuitry used with the adjustable printhead pressure mechanisms of FIGS. 5–8 and FIGS. 9–11. The electronics includes two microcomputers, a print engine microcomputer 202 and an image microcomputer 204. The print engine microcomputer 202 is primarily responsible for controlling the movement of the printer medium and the thermal transfer ribbon (if any) through the printer medium path 38 and supplying print timing commands to the printhead 80. The image microcomputer 204 produces the images which are to be printed on the printer medium. The print engine microcomputer 202 includes a print engine microprocessor 208, a read-only memory (ROM) 210, an input interface 212, and an output interface 214. The ROM 210 communicates with the print engine microprocessor 208 over bidirectional lines. The input interface 212 transmits input signals to the print engine microprocessor 208 and the print engine microprocessor 208 transmits output signals to the output interface 214.

The image microcomputer 204 includes an image microprocessor 216. The print engine microprocessor 208 and the image microprocessor 216 both communicate over bidirectional lines with a shared random access memory (RAM) 206. In addition, the print engine microprocessor 208 can communicate interrupt signals to the image microprocessor 216 and the image microprocessor 216 can communicate interrupt signals to the print engine microprocessor 208.

Through the output interface 214, the print engine microprocessor 202 sends control signals to a ribbon take-up drive 218, a ribbon supply drive 220, a stepper motor drive 222, and a head motor drive 224. The stepper motor drive 222 produces appropriate drive signals and transmits them to the stepper motor 50. Movements of the printer medium caused by the stepper motor 50 are sensed by the sensor 226 which produces signals that are transmitted to the input interface 212. The head motor drive 224 also produces appropriate signals and transmits them to the stepper motor 92, 150. Movements of the printhead 80 caused by the stepper motor 92, 150 are sensed by two sensors, the optical caliper detector 114 and a print module position sensor 228. The optical caliper detector 114 transmits signals to the input interface 212, indicating whether the printhead 80 is in the print mode or the idle mode. The print module position sensor 228 transmits signals to the input interface 212, indicating whether the printer module 34 is disengaged from the motor drive module 36.

As indicated above, detailed illustrative embodiments are disclosed herein. However, other embodiments, whioh may be detailed rather differently from the disclosed embodiments, are possible. Consequently, the specific structural and functional details disclosed herein are merely representative: yet in that regard, they are deemed to afford the best embodiments for the purposes of disclosure and to provide a basis for the claims herein, which define the scope of the present invention.

We claim:

1. Apparatus for variably adjusting pressure of a printhead against a print medium in accordance with a control signal, comprising:

means for receiving the control signal and producing a drive signal responsive thereto; and biasing means for applying a selectively adjustable biasing force on the printhead to adjust the pressure of the printhead against the print medium in response to the drive signal, the biasing means including a motor responsive to the drive signal for rotating a rotatable member about an axis, a rack having teeth driven by the rotatable member, a pivot arm having a free end, the pivot arm being connected to the printhead to apply a biasing force thereto in response to rotation of the rotatable member, and a spring connecting the rack to the pivot arm to generate the biasing force as the rotatable member rotates, the rotatable member being a pinion gear which drivably engages the rack.

2. The apparatus of claim 1 wherein the biasing means further includes a spring retainer fixed to the rack for movement therewith, and wherein the spring is received by the spring retainer and connected to a force transmitting member, the spring being compressed upon the movement of the spring retainer to apply the biasing force to the transmitting member, the transmitting member being connected to the pivot arm to transmit the biasing force thereto.

3. The apparatus of claim 2 wherein the spring retainer has a channel portion within which an arm receiver is slidably disposed for independent movement, the arm receiver having an opening to removably receive the free end of the pivot arm therein, the transmitting member being operatively connected to the arm receiver and the arm receiver transmitting the biasing force to the pivot arm, whereby the arm receiver can be slidably moved within the spring receiver channel portion to allow independent movement of the arm receiver and the spring receiver as the spring is compressed.

4. Apparatus for variably adjusting pressure of a printhead against a print medium in accordance with a control signal, comprising:

a receiver to receive the control signal and produce a drive signal responsive thereto; and biasing member to apply a selectively adjustable biasing force on the printhead to adjust the pressure of the printhead against the print medium in response to the drive signal, the biasing member including a motor responsive to the drive signal to rotate a rotatable member about an axis, a rack having teeth driven by the rotatable member, a pivot arm having a free end, the pivot arm being connected to the printhead to apply a biasing force thereto in response to rotation of teh rotatable member, and a spring connecting the rack to the pivot arm to generate the biasing force as the rotatable member rotates, the rotatable member being a pinion gear which drivably engages the rack.

5. The apparatus of claim 4 wherein the biasing member further includes a spring retainer fixed to the rack for movement therewith, and wherein the spring is received by the spring retainer and connected to a force transmitting member, the spring being compressed upon the movement of the spring retainer to apply the biasing force to the transmitting member, the transmitting member being connected to the pivot arm to transmit the biasing force thereto.

6. The apparatus of claim 5 wherein the spring retainer has a channel portion within which an arm receiver is slidably disposed for independent movement, the arm receiver having an opening to removably receive the free end of the pivot arm therein, the transmitting member being operatively connected to the arm receiver and the arm receiver transmitting the biasing force to the pivot arm, whereby the arm rceiver can be slidably moved within the spring receiver channel portion to allow independent movement of the arm receiver and the spring receiver as the spring is compressed.

7. Apparatus for variably adjusting pressure of a printhead against a print medium in accordance with a control signal, comprising:

a receiver to receive the control signal and produce a drive signal responsive thereto; and biasing member to apply a selectively adjustable biasing force on the printhead to adjust the pressure of the printhead against the print medium in response to the drive signal, the biasing member including a motor responsive to the drive signal to rotate a rotatable member about an axis, a rack having teeth driven by the rotatable member, a pivot arm having a free end, the pivot arm being connected to the printhead to apply the biasing force thereto in response to rotation of the rotatable member, and a spring connecting the rotatable member and a pivot pawl to generate the biasing force as the rotatable member rotates, wherein the spring has one end portion eccentrically connected to the rotatable member and an opposite end connected to the pivot pawl, the spring being extended upon the rotation of the rotatable member to apply the biasing force to the pivot pawl, the pivot pawl engaging the pivot arm to transmit the biasing force thereto, the pivot pawl and the pivot arm being selectively disengageable.

* * * * *

UNITED STATES PATENT AND TRADEMARK OFFICE

CERTIFICATE OF CORRECTION

PATENT NO. : 5,206,662

DATED : April 27, 1993

INVENTOR(S) : Duane M. Fox et al.

It is certified that error appears in the above-identified patent and that said Letters Patent is hereby corrected as shown below:

In column eight, claim four, line 55, please delete "teh" and substitute therefor "the".

In column nine, claim six, line eight, please delete "rceiver" and substitute therefor "receiver".

Signed and Sealed this

Fourteenth Day of December, 1993

Bruce Lehman

*Attest:*

BRUCE LEHMAN

*Attesting Officer*

*Commissioner of Patents and Trademarks*